US005790001A

United States Patent [19]

Waldo et al.

[11] Patent Number: 5,790,001

[45] Date of Patent: Aug. 4, 1998

[54] SHIELD AND CERAMIC FILTER

[75] Inventors: Michael Kip Eugene Waldo; David John Boughton, both of Phoenix, Ariz.; Reddy Ramachandra Vangala, Albuquerque, N. Mex.

[73] Assignee: Motorola, Inc., Schaumburg, Ill.

[21] Appl. No.: 805,190

[22] Filed: Feb. 27, 1997

[51] Int. Cl.[6] ..... H01P 1/20

[52] U.S. Cl. ..... 333/202; 333/207

[58] Field of Search ..... 333/202, 203, 333/204, 206, 207, 222, 223; 29/600

[56] References Cited

U.S. PATENT DOCUMENTS

| | | | |
|---|---|---|---|
| 4,439,747 | 3/1984 | Kreinheder et al. | 333/208 |
| 4,821,006 | 4/1989 | Ishikawa et al. | 333/219.1 X |
| 4,890,199 | 12/1989 | Beutler | 361/424 |
| 5,023,580 | 6/1991 | Kim et al. | 333/206 |
| 5,267,882 | 12/1993 | Davis | 439/680 |
| 5,278,527 | 1/1994 | Kenoun et al. | 333/206 X |
| 5,374,906 | 12/1994 | Noguchi et al. | 333/206 X |
| 5,557,144 | 9/1996 | Rosenstock et al. | 333/246 X |

FOREIGN PATENT DOCUMENTS

| | | | |
|---|---|---|---|
| 4-61501 | 2/1992 | Japan | 333/202 |
| 4-347906 | 12/1992 | Japan | 333/206 |

*Primary Examiner*—Seungsook Ham

*Attorney, Agent, or Firm*—Frederick M. Fliegel; John C. Scott

[57] ABSTRACT

An improved shield and ceramic filter. The shield includes (i) an upright portion (16) comprising a conductive material, (ii) a chamfered portion (22) disposed atop the upright portion (16), (iii) a horizontal portion (18) disposed on a distal portion of the chamfered portion (22) and (iv) one or more openings (20) disposed on the chamfered portion (22). The improved shield (12) desirably but not essentially further includes at least one slot (26) cut into a basal section of the upright portion (16). The at least one slot (26) allows a microstrip transmission line to pass under a portion of the shield (12).

21 Claims, 1 Drawing Sheet

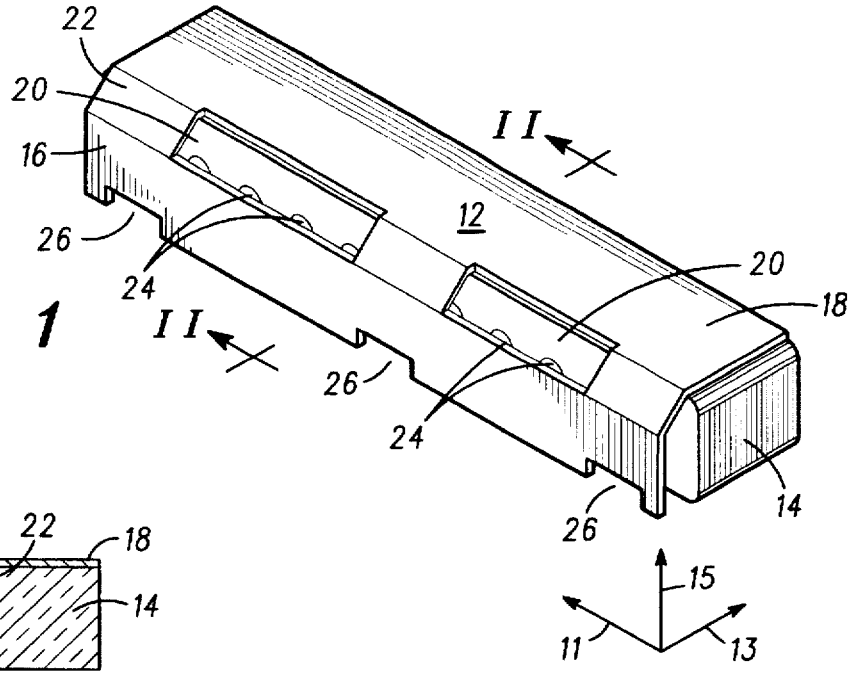
FIG. 1
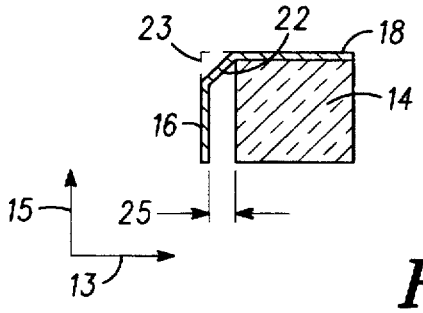
FIG. 2
FIG. 3
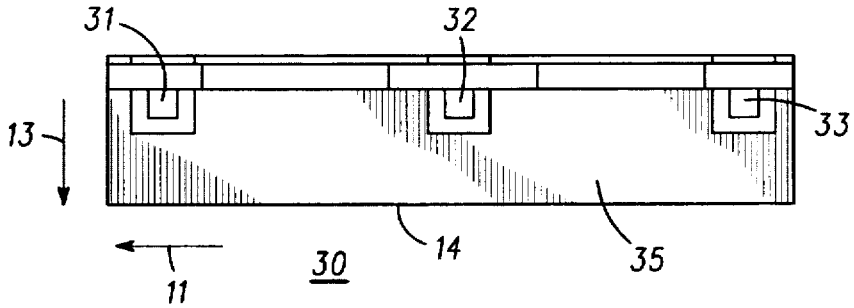
FIG. 4
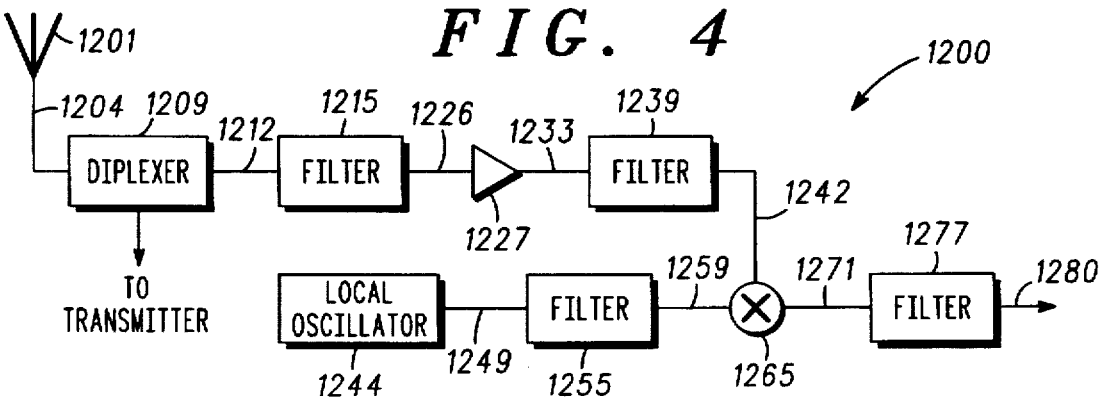

SHIELD AND CERAMIC FILTER

FIELD OF THE INVENTION

This invention relates in general to the field of frequency selection components, in particular to ceramic filters as frequency selection components and more particularly to improved shielding for ceramic filter frequency selection components.

BACKGROUND OF THE INVENTION

There is an ongoing need for ceramic filters for a variety of practical applications. Ceramic filters are becoming particularly important in the production of electronic signal processing equipment, especially radios, because they can be readily mass produced and are of small size. Ceramic filters are generally constructed on blocks of high dielectric constant, low loss tangent ceramic materials using thick film patterning techniques.

A number of low-loss ceramic filters design approaches have been developed to meet specific performance goals relevant to particular applications and subject to specified manufacturing constraints. One application in which ceramic filters provide great performance advantages is in duplexer applications, where a sensitive receiver and a transmitter, each tuned to slightly different frequencies, share an antenna. The duplexer acts to inhibit the transmitter from interfering with the receiver, despite the fact that both are coupled to the same antenna. Ceramic filters are preferred for this application, in part because of their power handling characteristics.

However, these and other prior art approaches suffer from a number of disadvantages well known in the art. These disadvantages tend to become more serious as pressure to provide physically small and very lightweight filters increases. One element in a ceramic filter is the shield that inhibits capacitive coupling between the filter and surrounding circuitry. This shield tends to also inhibit physical access to the filter once it has been installed. This, in turn, limits the amount of adjustment that can be carried out on the filter, resulting in a higher count of filters that do not meet specifications and that cannot be readily adjusted to meet specifications.

What is needed is an improved shield providing improved physical access to the ceramic filter even after the shield and filter are installed. What is also needed is a shield that allows greater tuning range to be achieved for a ceramic filter. What is additionally needed is a shield and filter combination that is light in weight when compared to prior art filters.

BRIEF DESCRIPTION OF THE DRAWINGS

FIG. 1 is a simplified isometric view of a ceramic filter and shield in accordance with the present invention;

FIG. 2 is simplified and enlarged side view, taken along section lines II—II of FIG. 1, of the ceramic filter and shield of FIG. 1, in accordance with the present invention;

FIG. 3 is a simplified bottom view of a ceramic filter in accordance with the present invention; and FIG. 4 is a block diagram of a portion of a radio frequency apparatus including a ceramic duplexer filter in accordance with the present invention.

DETAILED DESCRIPTION OF THE DRAWINGS

FIG. 1 is a simplified isometric view of ceramic filter and shield 10 in accordance with the present invention. Ceramic filter and shield 10 includes shield 12 and ceramic filter 14. Shield 12 has top 18, side 16, chamfered portion 22 and openings 20 positioned substantially along chamfered portion 22 but desirably also extending into top 18 and side 16. Side 16 also includes openings 26 distributed along the bottom edge thereof. Openings 26 allow microstrip transmission lines to be routed beneath the edge of shield 12 in order to provide input and/or output signal paths to and from ceramic filter and shield 10. Openings 26 are usefully 0.8 mm high (i.e., measured along a direction as indicated by direction arrow 15) and 3.3 mm long, measured along the long axis of ceramic filter/shield 10 as indicated by direction arrow 11. Spaces between openings 16 may act as solder lugs for securing shield 12 to a printed wiring board (not illustrated). Openings 20 allow adjustment of resonators 24 on ceramic filter 14.

Resonators 24 typically comprise openings or holes within ceramic filter 14, with the openings or holes being metallized and including metallization disposed on the external surface of ceramic filter 14. Ceramic filter 14 may have the frequency response thereof adjusted by mechanical trimming (e.g., by abrasion by a small, rapidly rotating abrasion tool) of the metallization shown in conjunction with resonators 24. The effect of trimming on individual resonators 24 causes the response of ceramic filter 14 to increase in frequency, allowing the filter response to be adjusted up in frequency and/or amplitude, depending on which resonators 24 are trimmed.

Shield 12 is typically constructed from cold rolled steel (e.g., 1010 steel), usefully 0.13 mm thick, desirably having a plating (e.g., hot dipped tin 0.005 mm thick) disposed thereon to facilitate soldering, although other materials and/or platings may be usefully employed. Shield 12, in one application, has a long dimension of 30.5 mm (measured along a direction as indicated by direction arrow 11), a height of 4.37 mm (measured along a direction as indicated by direction arrow 15) and a width of 7.25 mm (measured along a direction as indicated by direction arrow 13). Openings 20 in this instance usefully have a long dimension of 9.1 mm (measured along a direction as indicated by direction arrow 11) and a smaller dimension of 1.4 mm.

Ceramic filter 14 is typically fashioned from a block of barium titanate, having a relative dielectric constant $\epsilon_r$ of 37.5 and having dimensions of about 33 mm (measured along a direction as indicated by direction arrow 11)×6.23 mm (measured along a direction as indicated by direction arrow 13)×4.3 mm (measured along a direction as indicated by direction arrow 15). Ceramic filter 14 includes metallized regions 24 and other features for bandshaping. Metallized regions 24 are plated with thick film silver films (which feature high conductivity coupled with reasonable cost), although other platings may also be usefully employed.

FIG. 2 is simplified and enlarged side view, taken along section lines II—II of FIG. 1, of ceramic filter and shield 10 of FIG. 1, in accordance with the present invention. FIG. 2 shows that upright portion or side 16, chamfered portion 22 and horizontal member or top 18 collectively form a modified "L" shape when viewed on end. FIG. 2 also illustrates how chamfered portion 22 spaces side 16 away from ceramic filter 14 by a distance 25, allowing more room and easier access to resonators 24 (FIG. 1) of ceramic filter 14, facilitating tuning thereof and also enabling a broader tuning range. Distance 25 is usefully at least a millimeter. This broader tuning range, in turn, allows a higher percentage of ceramic filters 14 to be tuned to specification, increasing yield.

Chamfered portion 22 helps to auto-locate shield 12 on ceramic filter 14, during assembly, such that separation 25 is consistent. Without chamfer 22, spacing 25 is typically maintained via complex external fixturing. Presence of chamfered portion 22 reduces fixture complexity and increases reliability with which spacing 25 is achieved, which results in improved assembly yield.

It will be appreciated that chamfered portion 22 includes less total material and occupies less total volume than would be required in a right-angled shield (see dashed line 23) having the same separation 25 between side 16 and ceramic filter 14, i.e., in a filter and shield assembly that provides similar access to ceramic filter 14 for tuning and adjustment. Accordingly, use of a chamfered portion 22 results in a lighter and smaller shield 12 than would a similar spacing provided via rectangular shield 23, while preserving spacing 25 and thus facilitating tuning via mechanical abrasion. This, in turn, results in a lighter finished product, such as a cellular telephone or portable radio.

FIG. 3 is a simplified bottom view 30 of ceramic filter 14 in accordance with the present invention. Bottom view 30 illustrates ground plane 35 comprising, e.g., silver thick film applied to the base of ceramic filter 14, which serves as a further shielding element and which also provides a mechanical coupling (via solder) to the circuit board (not illustrated) on which ceramic filter and shield 10 is mounted. Inputs 31 (e.g., transmitter), 33 (e.g., receiver) and output 32 (e.g., antenna) couple via microstrip extending through openings 26 in shield 12, although it will be appreciated that stripline interconnections may also be employed on multilayer printed wiring boards. Shield 12 and ground plane 35 in combination provide shielding on the three largest faces of ceramic filter 14, i.e., form the bulk of a Faraday cage about ceramic filter 14. Appropriate design of ceramic filter 14 results in effective shielding for the remaining sides being incorporated directly within ceramic filter 14, or ceramic filter 14 may be strategically placed with respect to other components.

EXAMPLE

FIG. 4 is a block diagram of portion 1200 of a radio frequency apparatus including a ceramic duplexer filter in accordance with the present invention. Apparatus 1200 includes antenna 1201 and antenna lead 1204, by way of example, used to receive and/or transmit signals. Antenna lead 1204 couples, e.g., to terminal 32 (FIG. 3).

Alternatively, antenna 1201 and antenna lead 1204 could be replaced by a fiber-optic link or a cable or other signal transmissive media. Duplexer 1209 is coupled to antenna 1201 and antenna lead 1204 and to a transmitter portion (not shown), analogous to terminal 31, FIG. 3. Duplexer 1209 couples received signals to filter 1215 via lead 1212 (analogous to terminal 33, FIG. 3). Filter 1215 is coupled to amplifier 1227 via lead 1226.

The output of amplifier 1227 is coupled to filter 1239 via lead 1233. Filter 1239 couples its output signal to mixer 1265 where the signal coupled by lead 1242 is combined with another signal from local oscillator 1244 coupled via filter 1255 and leads 1249 and 1259. The signal which is output from mixer 1265 via lead 1271 is then passed through filter 1277 to provide an intermediate frequency or IF output signal via lead 1280. Duplexer 1209 may comprise a shielded ceramic filter according to the present invention.

Thus, an improved shield and ceramic duplexer filter has been described which overcomes specific problems and accomplishes certain advantages relative to prior art methods and mechanisms. The improvements over known technology are significant.

The foregoing description of the specific embodiments will so fully reveal the general nature of the invention that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments. For example, openings 20 may be positioned such that they are confined to chamfered region 22 or may extend into side 16 and/or top 18, as required for the specific application.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

We claim:

1. An improved shield for a ceramic filter comprising:

an upright shield portion;

a chamfered shield portion disposed atop said upright shield portion; and a horizontal shield portion disposed on a distal portion of said chamfered shield portion, said upright shield portion, chamfered shield portion and horizontal shield portion comprising conductive materials having a modified "L" shape when viewed on end;

wherein said shield is placed about a ceramic filter;

wherein said chamfered shield portion includes one or more openings for tuning a metallized surface of said ceramic filter and said chamfered shield portion spaces said upright shield portion away from said ceramic filter when said shield is in place about said ceramic filter providing easier access to said ceramic filter for tuning said ceramic filter.

2. An improved shield as claimed in claim 1, further comprising at least one slot cut into a basal section of said upright shield portion, said at least one slot for allowing a microstrip transmission line to pass under a portion of said upright shield portion.

3. An improved shield as claimed in claim 2, further comprising solder lugs disposed along those portions of said basal section other than said at least one slot.

4. An improved shield as claimed in claim 1, wherein said upright portion, said chamfered portion and said horizontal portion substantially surround at least two adjacent faces of said ceramic filter when said shield is in place about said ceramic filter.

5. An improved shield as claimed in claim 1, wherein said one or more openings extend from said chamfered shield portion into at least one of said upright shield portion and said horizontal shield portion.

6. An improved shield as claimed in claim 1, wherein said upright shield portion, said chamfered shield portion, and said horizontal shield portion comprise a single piece of sheet metal.

7. An improved shield as claimed in claim 6, wherein said single piece of sheet metal comprises a single piece of cold rolled steel.

8. An improved shield as claimed in claim 7, wherein said single piece of cold rolled steel is tin plated.

9. A method for use in making a shielded ceramic filter, said method comprising steps of:

providing an upright shield portion;

disposing a chamfered shield portion atop said upright shield portion; and including a horizontal shield portion disposed on a distal portion of said chamfered shield portion, wherein said upright shield portion, chamfered shield portion and horizontal shield portion comprise conductive materials having a modified "L" shape when viewed on end;

wherein said steps of providing, disposing, and including define a shield for placement about a ceramic filter;

wherein said step of disposing includes disposing a chamfered shield portion to auto-locate said shield about said ceramic filter during assembly of said shielded ceramic filter.

10. A method as claimed in claim 9, further comprising a step of disposing said ceramic filter within said shield.

11. A method as claimed in claim 9, further comprising a step of disposing one or more openings on said chamfered shield portion for use in tuning said ceramic filter, wherein said chamfered shield portion spaces said upright shield portion away from said ceramic filter, when said shield is in place about said ceramic filter, thereby providing easier access to said ceramic filter for purposes of tuning said ceramic filter.

12. A method as claimed in claim 9, further comprising a step of providing at least one slot cut into a basal section of said upright shield portion, said at least one slot for allowing a microstrip transmission line to pass under a portion of said upright shield portion.

13. A method as claimed in claim 12, further comprising a step of disposing solder lugs along those portions of said basal section other than said at least one slot.

14. A method as claimed in claim 9, wherein said providing, disposing and including steps include a step of providing an upright shield portion, a chamfered shield portion and a horizontal shield portion comprising a single piece of sheet metal.

15. A method as claimed in claim 11, wherein said step of disposing one or more openings includes a step of disposing one or more openings extending into at least one of said upright shield portion and said horizontal shield portion.

16. A method as claimed in claim 9, wherein said providing, disposing and including steps include a step of providing an upright shield portion, a chamfered shield portion and a horizontal shield portion comprising a single piece of cold rolled steel.

17. A method as claimed in claim 16, further including a step of tin plating said single piece of cold rolled steel.

18. A shielded ceramic filter made using the method of claim 10.

19. A radio including a shielded ceramic filter assembly, said filter assembly comprising:

a ceramic filter including a block of dielectric material; and a shield surrounding said ceramic filter, said shield having:

an upright shield portion;

a chamfered shield portion disposed atop said upright shield portion; and a horizontal shield portion disposed on a distal portion of said chamfered shield portion, said upright shield portion, said chamfered shield portion and said horizontal shield portion comprising conductive material having a modified "L" shape when viewed on end;

wherein said chamfered shield portion includes one or more openings for tuning a metallized surface of said ceramic filter and said chamfered shield portion spaces said upright shield portion away from said ceramic filter, when said shield is in place about said ceramic filter providing easier access to said ceramic filter for tuning said ceramic filter.

20. A radio as claimed in claim 19, said shielded ceramic filter assembly further comprising:

at least one slot cut into a basal section of said upright shield portion, said at least one slot for allowing a microstrip transmission line to pass under a portion of said upright shield portion; and one or more solder lugs disposed along those portions of said basal section other than said at least one slot.

21. A radio as claimed in claim 19, wherein:

said upright shield portion, said chamfered shield portion and said horizontal shield portion substantially surround at least two adjacent faces of said ceramic filter; and said upright shield portion, said chamfered shield portion and said horizontal shield portion comprise a single piece of sheet metal.

* * * * *